United States Patent [19]

Jensen

[11] Patent Number: 4,773,605

[45] Date of Patent: Sep. 27, 1988

[54] CUTTING GRINDER PREFERABLY FOR GRINDING ORGANIC MATERIAL SUCH AS DEAD BEASTS

[76] Inventor: Erik Evald E. Jensen, Norre Allé 20, Middelfart, Denmark, 5500

[21] Appl. No.: 51,685

[22] PCT Filed: Aug. 26, 1986

[86] PCT No.: PCT/DK86/00095

§ 371 Date: Apr. 23, 1987

§ 102(e) Date: Apr. 23, 1987

[87] PCT Pub. No.: WO87/01304

PCT Pub. Date: Mar. 12, 1987

[30] Foreign Application Priority Data

Aug. 26, 1985 [DK] Denmark ..... 3873/85

[51] Int. Cl.[4] ..... B02C 4/30; B02C 18/18

[52] U.S. Cl. ..... 241/243; 241/294

[58] Field of Search ..... 299/91, 92, 93; 241/243, 293, 294, 242, 224, 245

[56] References Cited

U.S. PATENT DOCUMENTS

| | | | |
|---|---|---|---|
| 1,756,986 | 5/1930 | Miller | 241/294 X |
| 2,652,749 | 9/1953 | Hagmeister | 241/294 X |
| 2,989,295 | 6/1961 | Prox | 299/91 X |
| 3,390,839 | 7/1968 | Smith | 241/294 |

*Primary Examiner*—Mark Rosenbaum

*Attorney, Agent, or Firm*—Darby & Darby

[57] ABSTRACT

The cutters (9) in a cutting grinder have according to the invention the shape of a rectangular parallelepiped which can be partly inserted into co-operating box-shaped sockets in the surface of the drum (8). The cutters (9) are retained by balls (14) which by means of a pin (13) being screwed in through the outer face of the plate (9) are pressed into a groove (7) arranged in the side of the socket. It is thereby possible to replace or to turn the cutters (9) by simply screwing out the pin (13) and so avoid the hard and difficult process of welding the cutters to the drum. It is thus possible to lower maintenance costs of the cutting grinder substantially just as it is possible according to requirements to mount cutters of different shape and number. The cutting grinder thus becomes universal.

4 Claims, 3 Drawing Sheets

CUTTING GRINDER PREFERABLY FOR GRINDING ORGANIC MATERIAL SUCH AS DEAD BEASTS

Figure 1:
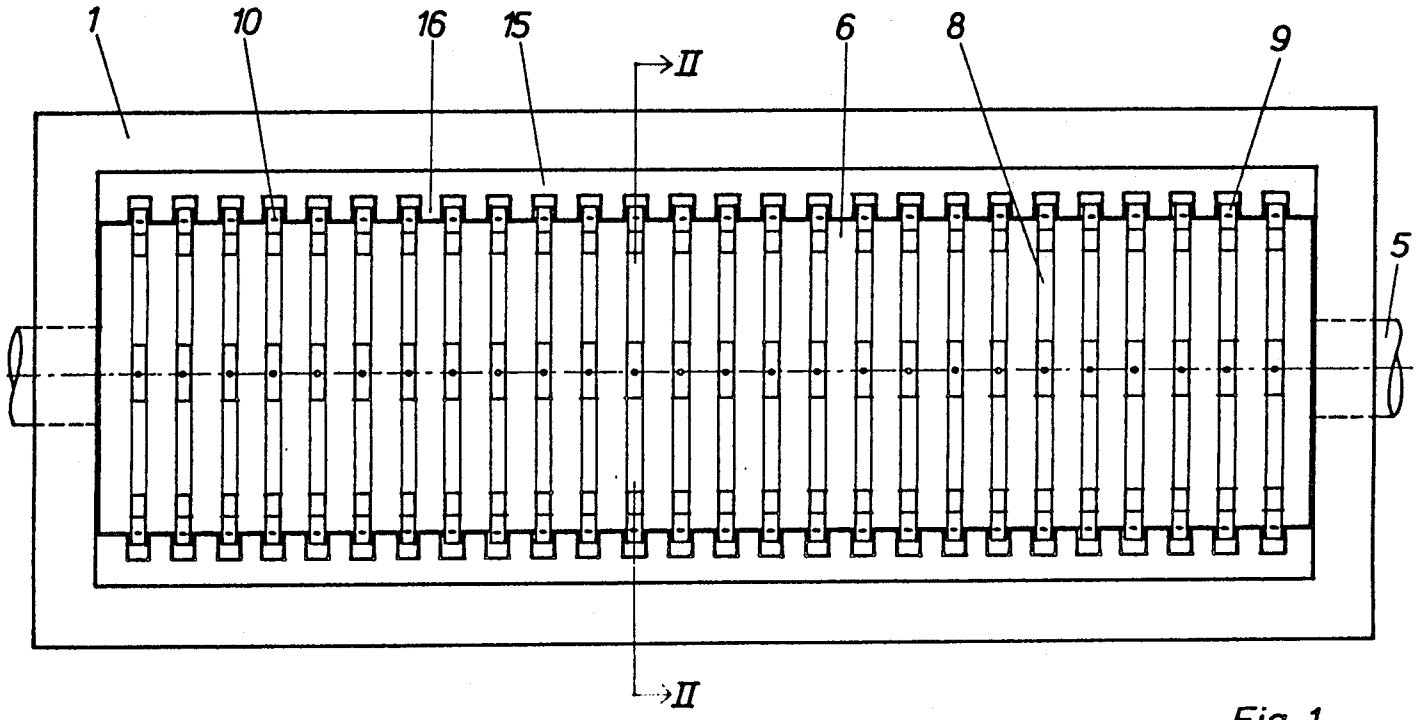

The invention relates to a cutting grinder preferably for grinding organic material such as dead beasts, offal and the like and comprising a rotatable drum which on its circumference is provided with a number of protruding cutters spaced at given intervals and where there are provided stationary grate fingers extending into the space between the cutters.

Grinders of this kind are used for grinding and cumminuting dead beasts, animals which have been condemned by veterinary inspectors, offal from bacon factories and cattle slaughterhouses consisting of bones and bowels from the slaughtered animals etc. The organic material is placed on top of the rotating drum and parts of the material are carried along by the rotation, and by the passsage of the cutters between the grate fingers the material will be comminuted and be discharged through the bottom of the grinder. Grinders of this kind are also used for grinding and comminuting other organic and inorganic materials.

The purpose of grinding the organic or inorganic material may for example be to change the particle size of the material with a view to obtaining advantages by the subsequent processing of the material in connection with the utilisation of the components of the material or in connection with storing.

Conventional grinders are provided with cutters which either form an integral part of the drum or are secured to drum or shaft by welding or are secured by bolts to the drum or form part of a drum segment which is secured to a shaft by tongue and groove or form part of a drum segment having a polygonal hole and which is secured to a co-operating polygonal shaft.

In operation one or more cutters may break just as the cutters will become worn after some time depending on the type of material and the load.

When such cutters are to be replaced, the old cutter will have to be removed and a replacement cutter mounted or welded. Removal of the old cutters requires a considerable work performance in that the parts are usually deformed and damaged by wear and impacts. Also the mounting of replacement cutters usually requires a considerable work performance with regard to adaptation and strict observation of tolerances in connection with the placing of the cutters on the drum or shaft.

In cases where the securing of cutters takes place by welding, there is moreover a risk of crack formation around the weld arising from socalled hydrogen cracks and/or thermal strains in the cutters and/or the parent material with the resulting risk of breaks when the cutter is loaded in operation.

It is the object of the invention to remedy these difficulties in repairing the known cutting grinders and this is achieved when the cutters have the shape of a substantially rectangular parallelepiped which can be partly inserted into co-operating box-shaped sockets in the drum and where each cutter is provided with expansion means for jamming against the sides of the socket.

A drum of this kind with cutters of rectangular steel plate and with expansion means built into the cutter will permit considerable simpler and easier repair since the removal of the cutter from the drum by relieving the expansion can be effected without welding. The expansion may be relieved by simple means and a cutter may be released from the drum and a new one inserted in a similar manner. Since the cutters have been inserted into a socket abutting closely on the four sides and bottom of the cutter, all stresses of the cutter are transmitted to the surrounding drum material so that the expansion means will just have to ensure that the cutter does not fall out when in operation. Relatively little retaining power is required for this purpose and therefore the expansion means may be designed simple and small. At the same time operation of these means becomes easier since they are not exposed to any heavy loads. Finally, if worn down, a cutter which is symmetrical about its centre line may easily be removed and turned 180° thus producing a new cutter edge. In this manner a cutter may last twice as long in that it may be turned.

Finally, the present structure opens up the possibility of mounting cutters having different shapes, the only requirement being that the portion in the socket is of the same dimension and that the cutter is provided with the required expansion means. It is thereby possible to build up a grinder for specific purposes by merely replacing the cutters.

By letting pawls extend from the opposite sides of the cutter and engage with corresponding hollows in the sides of the socket a cutter may be easily mounted and released from the drum.

By letting the pawls have the shape of balls for engagement in a groove in the sides of the socket the expansion may easily be performed by pressing out the balls.

By screwing in the pin from outside the balls may be expanded and released by controlling the pin from the outside of the cutter.

Figure 2:
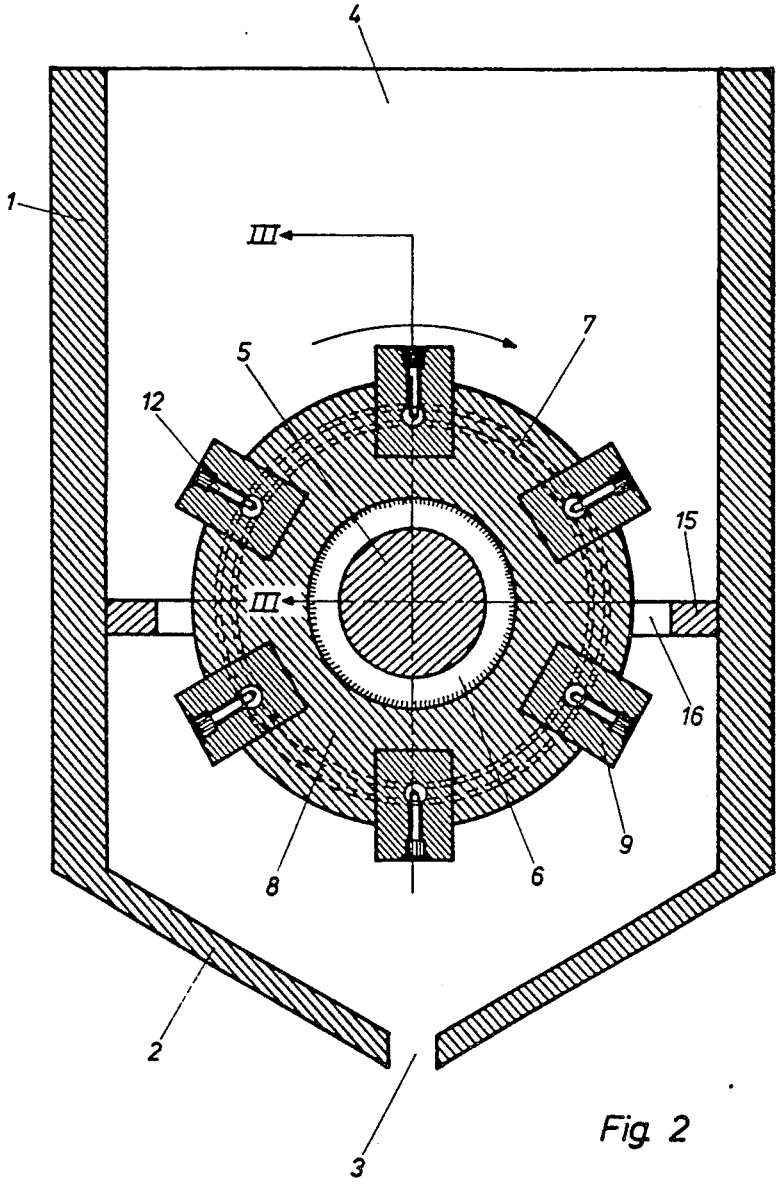
Figure 3:
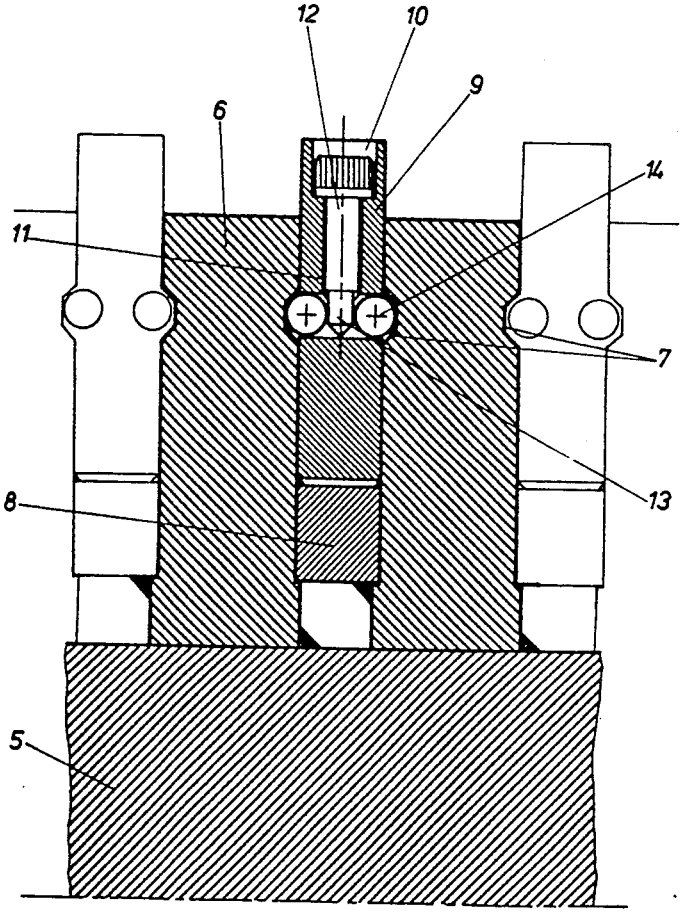

The invention will be further described in the following with reference to the drawing wherein FIG. 1 shows a top view of a cutting drum mounted in the grinder, FIG. 2 shows a sectional view of the grinder seen in the direction II—II in FIG. 1, and FIG. 3 shows a partial view of the drum with a cutter mounted thereon at a larger scale seen in the direction III—III in FIG. 2.

On the drawing there is shown an example of a preferred embodiment of a cutting grinder according to the invention.

In FIG. 1 showing a top view of the grinder, the shaft 5 is seen which rotates the drum in the grinder housing by means of a not shown motor.

FIG. 2 shows a sectional view of the grinder housing comprising lateral walls 1 forming the feed opening 4 at the top and having oblique bottom walls 2 forming the discharge 3 at the bottom.

On both lateral walls 1 there is inwardly mounted a longitudinally extending grate 15 with grate fingers 16 extending inwardly towards the drum.

As shown in FIGS. 2 and 3, the drum is built up by units consisting of annular intermediate disks 6 welded to the shaft 5. In both sides of the disks 6 there is turned a groove 7 extending somewhat within the disk and having the cross-section shown in FIG. 3.

In the space between these disks 6 there is mounted a cutter retaining plate 8 provided with sockets. There are six sockets in the shown example and they are evenly spaced in each retaining plate as shown in FIG. 2.

The retaining plates 8 are mounted between the disks 6 and welded to same. When mounting the drum a plate 8 is welded to a disk 6 and the parts welded together are slid onto the shaft 5 and welded to same. The process is continued until the drum has been completed.

The cutters 9 proper are shown laterally in FIG. 2 and sectionally in FIG. 3. They consist of a rectangular steel plate which is partly provided with a transverse bore about its centre and partly with a threaded bore 11 extending perpendicularly to the bore, the threaded bore 11 being widened at the top for forming a countersink 10.

As will clearly appear from FIG. 3, there are arranged two balls 14 in the bore in that the balls may roll somewhat out into the groove 7 arranged in the intermediate disk 6. This will be the case when a pin 13 arranged on a hexagon socket head bolt 12 is screwed into the thread 11. Thus the bolt head is completely sunk in the bore 10 in the cutter. In this manner it is possible to create a completely concealed expansion of the balls 14 in the grooves 7 and thus a completely protected locking of the cutters 9 in the sockets.

When a cutter is to be mounted, turned or replaced, the bolt 12 is turned by means of an Allen key which is possible without dismounting the drum.

When the bolt has been screwed so far out that the pin 13 is out of the passage for the balls 14, the cutter 9 may be drawn out of or inserted into the socket since the balls will be pressed into the passage and thus be disengaged from the grooves 7. When the cutter is home within the socket, the bolt 12 can again be screwed in and the pin will press out the balls for expansion and engagement with the groove 7.

Since such operation does not require any other equipment than the tools necessary for turning the bolt, this operation may take place easily and quickly which is of great importance to the continuous operation of the grinder.

Above there is shown and described an expansion of ball units but it is within the scope of the invention to use other forms of units or blocks which can be pressed out for engagement with hollows or grooves arranged in the side of the sockets.

I claim:

1. Cutting grinder for grinding organic material, the grinder including a rotatable drum which on its circumference is provided with a number of protruding cutters spaced at given intervals and where there are provided stationary grate fingers extending into the space between the cutters, characterised in that the cutters (9) have the shape of a substantially rectangular parallelepiped which can be partly inserted into co-operating box-shaped sockets in the drum (8) and where each cutter (9) is provided with expansion means (13,14) for jamming against the sides of the socket.

2. Cutting grinder according to claim 1, characterised in that the expansion means comprise pawls (14) projecting laterally of the cutters (9) and that the sides of the socket are provided with hollows (7) to receive the pawls (14) when same are in their expanded position.

3. Cutting grinder according to claim 2, characterised in that the pawls (14) are substantially ball-shaped and that the hollows have the shape of grooves (7) wherein the balls (14) may be partly pressed in.

4. Cutting grinder according to claim 3, characterised in that the balls (14) are separated by means of a pin (13) which is screwed in from outside through a threaded bore (10,11) extending from the outer face of the cutter (9) and into the space between the balls (14).

* * * * *